US010584872B2

(12) United States Patent
Gilioli et al.

(10) Patent No.: US 10,584,872 B2
(45) Date of Patent: Mar. 10, 2020

(54) BURNER

(71) Applicant: Worgas Bruciatori S.r.l., Formigine, Modena (IT)

(72) Inventors: Massimo Gilioli, Formigine (IT); Massimo Dotti, Formigine (IT); Jimmy Nassiboo, Formigine (IT); Antonio Acocella, Formigine (IT)

(73) Assignee: Worgas Bruciatori S.r.l., Formigine (IT)

( * ) Notice: Subject to any disclaimer, the term of this patent is extended or adjusted under 35 U.S.C. 154(b) by 201 days.

(21) Appl. No.: 15/790,479

(22) Filed: Oct. 23, 2017

(65) Prior Publication Data

US 2018/0112870 A1 Apr. 26, 2018

(30) Foreign Application Priority Data

Oct. 24, 2016 (IT) ..... 102016000106728

(51) Int. Cl.

| | |
|---|---|
| ***F23D 14/24*** | (2006.01) |
| ***F23D 14/58*** | (2006.01) |
| ***F23D 14/10*** | (2006.01) |
| ***F23D 14/02*** | (2006.01) |
| ***F23D 14/62*** | (2006.01) |
| ***F23D 14/70*** | (2006.01) |

(52) U.S. Cl.

CPC ..... *F23D 14/58* (2013.01); *F23D 14/02* (2013.01); *F23D 14/10* (2013.01); *F23D 14/24* (2013.01); *F23D 14/62* (2013.01); *F23D 14/70* (2013.01); *F23D 2203/007* (2013.01); *F23D 2203/1012* (2013.01); *F23D 2210/00* (2013.01); *F23D 2900/00003* (2013.01); *F23D 2900/14241* (2013.01)

(58) Field of Classification Search

CPC ..... F23D 14/58
USPC ..... 431/354
See application file for complete search history.

(56) References Cited

U.S. PATENT DOCUMENTS

| | | | | |
|---|---|---|---|---|
| 2,729,059 A * | 1/1956 | Foure | F23R 3/00 | 60/39.461 |
| 2,753,218 A * | 7/1956 | Kelsey | F23D 11/383 | 239/496 |
| 3,391,983 A * | 7/1968 | Harazono | F23C 99/00 | 431/329 |
| 3,733,170 A * | 5/1973 | Kobayashi | F23D 14/145 | 431/329 |
| 2007/0054228 A1* | 3/2007 | Fogliani | F23D 14/06 | 431/354 |

(Continued)

FOREIGN PATENT DOCUMENTS

| | | |
|---|---|---|
| EP | 1 731 834 A1 | 12/2006 |
| EP | 3 006 826 A1 | 4/2016 |
| JP | 56-12908 A | 2/1981 |

*Primary Examiner* — Avinash A Savani
(74) *Attorney, Agent, or Firm* — Blank Rome LLP

(57) ABSTRACT

A burner comprises a tubular diffuser wall and an inlet passage of a gas mixture in the diffuser wall, as well as a distribution diaphragm having a distribution opening which forms a central passage section and a plurality of peripheral passage sections, in the shape of rays or branches, extending from the central passage section towards the diffuser wall, and in which the peripheral passage sections and the central passage section are connected together to form a single hole.

19 Claims, 6 Drawing Sheets

(56) References Cited

U.S. PATENT DOCUMENTS

2012/0196237 A1* 8/2012 Murray ..... F23D 14/46
431/354

* cited by examiner

BURNER

BACKGROUND OF THE INVENTION

1. Field of the Invention

The present invention relates to a gas burner for boilers and for industrial applications, of the type comprising:

- a support wall which can be connected to a combustion chamber of the boiler or of the industrial application, the support wall having an inlet opening for introducing a mixture of fuel gas and oxidant into the burner,
- a tubular diffuser wall having a first end connected to the support wall in flow communication with the inlet opening, a second end closed by means of a closing bottom, and a perforation for the passage of the gas mixture from inside the burner to an outer side of the diffuser wall where combustion takes place,
- at least one distribution diaphragm arranged in the inlet passage to distribute the fuel mixture at the inlet in the burner.

2. Description of the Related Art

In the known art, the distribution diaphragm has a plurality of passage openings distributed over the extension of the diaphragm.

This known burner aims to overcome problems of local overheating and of flame instability encountered in burners without a distribution diaphragm or provided with flow elements, for example so-called noise-control horns, different from the distribution diaphragm.

Known multi-hole distribution diaphragms emphasize the formation in the burner of a plurality of separate gas flows, which tend to cause relatively concentrated areas of increased crossing on the diffuser, which are separated from one another by reduced crossing areas. FIG. 1 shows a multi-hole diaphragm with a central circular hole and a series of further holes, e.g. elongated holes, arranged along a circumference around the central hole. FIG. 2 shows a radial segment of a simulation model of a cylindrical burner with the distribution diaphragm in FIG. 1, and with the flow lines obtained by means of a numeric simulation of the operation of the burner. There is an evident formation of a central flow and a further radially outer flow, in which a first part of the radially outer flow directly crosses the diffuser in an area close to the burner inlet, thus causing a first but reduced area of increased crossing. A second part of the radially outer flow is sucked into the central flow and conveyed together therewith through the diffuser into an area far from the burner inlet, thus causing a second and more extended area of increased crossing. There is formed, between the two main gas flows, in the lower region of the burner, a strong vorticity which hinders the arrival of fuel mixture to an intermediate lower region between the first and second areas of increased crossing, which intermediate area of the diffuser remains almost without flow lines and therefore, is not highly exploited for the purposes of combustion.

SUMMARY OF THE INVENTION

It is the object of the present invention to improve burners and distribution diaphragms of the known art so as to further uniform the fuel gas flow over the combustion surface of the diffuser.

Indeed, the more uniform the distribution of the fuel gas over the diffuser, the more stable the flame and the more the risk of local overheating of the diffuser wall is reduced.

It is a further object of the invention to reduce the thermoacoustic noise, i.e. the noise emissions generated by the burner.

It is a more specific object of the invention to alternate areas with a laminar fuel gas flow with areas with a turbulent fuel gas flow by means of a same, preferably single, passage opening of the distribution diaphragm.

The object of the invention is achieved by means of a burner as described below and set forth in the independent claim. The dependent claims relate to advantageous embodiments.

According to one aspect of the invention, a burner comprises:

- a support wall which can be connected to a combustion chamber of the boiler or of the industrial application, said support wall forming an inlet passage for introducing a fuel gas mixture into the burner,
- a diffuser wall connected to the support wall in flow communication with the inlet passage and having a perforation for the passage of the gas mixture from inside the burner to an outer side of the diffuser wall where combustion takes place,
- a distribution diaphragm arranged in the inlet passage and having a through distribution opening,
- in which the distribution opening forms a central passage section distant from the diffuser wall and a plurality of peripheral passage sections, in the shape of rays or branches, extending from the central passage section towards the diffuser wall, and in which the peripheral passage sections and the central passage section are connected together to form a single hole.

Generalizing, it could be a distribution diaphragm with a single tentacular-shaped or branched through opening and which extends both in the central region (distant from the diffuser wall) and in the peripheral region (close to the diffuser wall) of the diaphragm.

Thanks to the combination of central and peripheral passage sections connected to one another, the formation of concentrated flows in the burner which are completely detached from one another and are alternated by areas of pronounced vorticity, may be reduced, and as a result of experimentations and numeric simulations carried out, a more uniform distribution of the fuel gas over the diffuser wall is obtained (FIG. 4).

BRIEF DESCRIPTION OF THE DRAWINGS

To better comprehend the invention and appreciate the advantages thereof, below are described certain non-limiting embodiments, while referring to the drawings, in which.

DETAILED DESCRIPTION OF THE PREFERRED EMBODIMENTS

Figure 1:
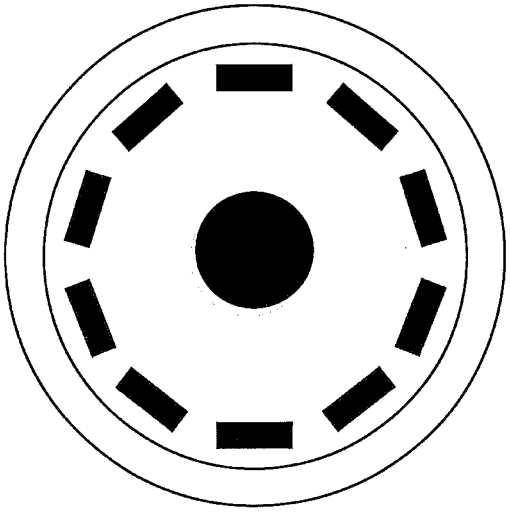
FIG. 1 is a top view of a distribution diaphragm of the known art.
Figure 2:
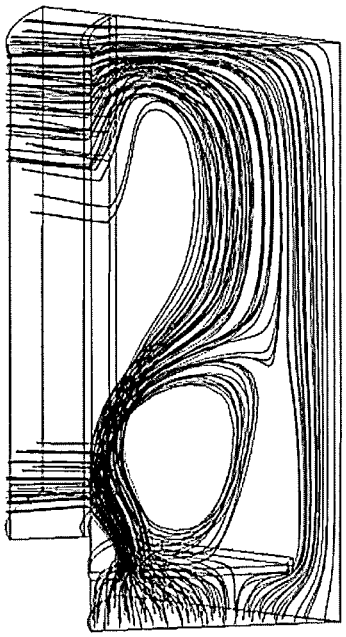
FIG. 2 shows the fluid-dynamic behavior of a cylindrical burner with the distribution diaphragm in FIG. 1.
Figure 3:
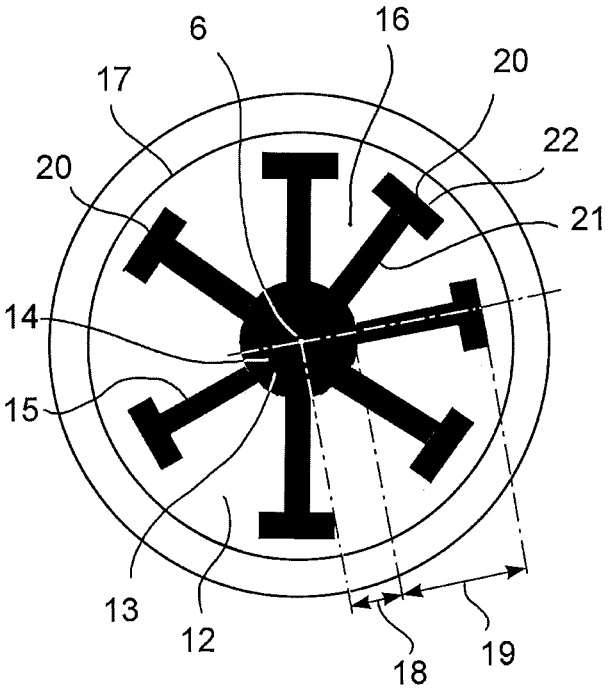
FIG. 3 is a top view of a distribution diaphragm according to an embodiment of the invention.

With reference to the figures, a gas burner for boilers or for industrial applications which generates heat by means of the combustion of a fuel gas in general or of a pre-mixture of fuel gas and air in particular, is indicated as a whole with numeral 1. Burner 1 comprises a support wall 2 which can be connected to a combustion chamber of the boiler or of the industrial application, the support wall 2 forming an inlet passage 3 for introducing a mixture 4 of fuel gas and oxidant into burner 1.

Burner 1 further comprises a tubular diffuser wall 5 which is possibly coaxial with respect to a longitudinal axis 6 of burner 1, and having a first end 7 connected to the support wall 2 in flow communication with the inlet passage 3, and a second closed end 8, for example by means of a closing bottom 9, and a perforation 10 for the passage of the gas mixture 4 from inside burner 1 to an outer side 11 of the diffuser wall 5 where combustion takes place.

A closed end portion, for example cap-shaped, of the diffuser wall 5 itself may be provided in place of the closing bottom 9.

Burner 1 further comprises a distribution diaphragm 12 arranged in the inlet passage 3 and having a through distribution opening 13. During the operation of burner 1, the fuel gas 4 crosses the distribution opening 13 which affects the distribution of the gas flow in burner 1.

According to one aspect of the invention, the distribution opening 13 forms a central passage section 14 distant from the diffuser wall 5 and a plurality of peripheral passage sections 15, in the shape of rays or branches, extending from the central passage section 14 towards the diffuser wall 5, in which the peripheral passage sections 15 and the central passage section 14 are connected together to form a single hole.

Generalizing, the distribution opening 13 may be defined like with a single tentacular-shaped or branched through opening and which extends both in the central region (distant from the diffuser wall 5) and in the peripheral region (close to the diffuser wall 5) of diaphragm 12.

The central passage section 14 advantageously, but not necessarily, is formed exactly at the geometric middle of the distribution diaphragm 12, but it preferably includes the geometric middle of the distribution diaphragm 12, although not necessarily in concentric manner.

The peripheral passage sections 15 instead extend into an area of the distribution diaphragm 12 between the geometric middle thereof and (a peripheral edge thereof adjacent to) the diffuser wall 5.

Figure 4:
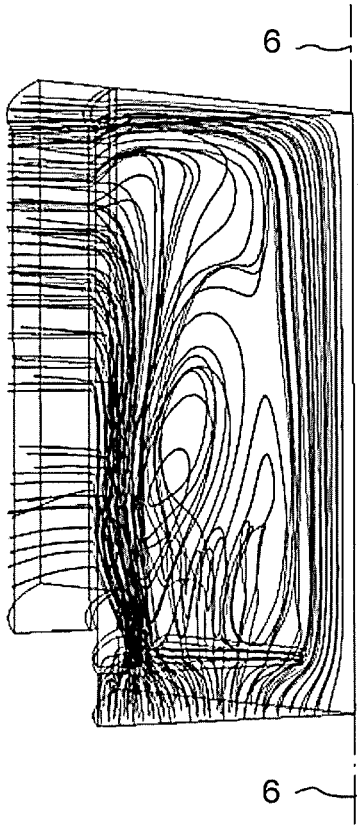
FIG. 4 shows the fluid-dynamic behavior of a cylindrical burner with the distribution diaphragm in FIG. 3.
Figure 5:
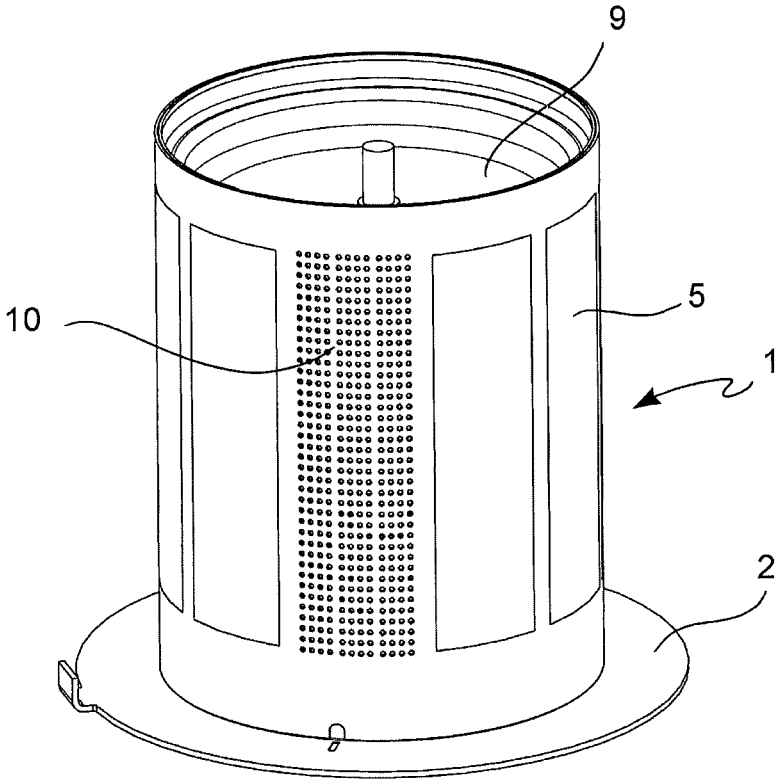
FIG. 5 is a perspective view of a burner according to an embodiment of the invention.

Thanks to the combination of central 14 and peripheral 15 passage sections connected to one another, it is possible to reduce the formation of concentrated flows in burner 1 which are completely detached from one another and are alternated with areas of pronounced vorticity, and as a result of experimentations and numeric simulations carried out, a more uniform distribution of the fuel gas over the diffuser wall 5 is obtained (FIG. 4). Moreover, due to the configuration of the central 14 and peripheral 15 passage sections connected to one another, there are obtained areas with laminar fuel gas flow alternated with areas with turbulent fuel gas flow (FIGS. 16 to 19), by means of a same, preferably single, distribution opening 13 of the distribution diaphragm 12.

According to one embodiment, diaphragm 12 is made of metal sheet, preferably of steel.

Diaphragm 12 is preferably substantially planar and orthogonal to the longitudinal axis 6.

Alternatively, diaphragm 12 may have a rounded shape, for example a flattened dome, or it may form circumferential and/or radial steps with respect to the longitudinal axis 6.

Diaphragm 12 and the distribution opening 13 may have a substantially symmetrical shape with respect to the longitudinal axis 6, as shown by way of example in FIGS. 3, 7, 8, 11.

Alternatively, the distribution opening 13 may have an asymmetrical or inversely symmetrical, or simply non-symmetrical, shape with respect to the longitudinal axis 6, as shown by way of example in FIGS. 9, 12, 13, 14.

In one embodiment (FIGS. 3, 8-13), the central passage section 14 of the distribution opening 13 is circular or polygonal and concentric with the longitudinal axis 6.

The peripheral passage sections 15 preferably extend radially outwardly (FIGS. 3, 8 to 13) so as to form/delimit a corresponding series of sheet metal tabs 16 therebetween, such tabs projecting from a peripheral edge 17 of diaphragm 12 cantilevered radially inwardly (with inner end free).

This configuration allows the tabs to carry out thermal expansions and deformations caused by thermal expansions of the diffuser in a free and independent manner, and significantly reduces the formation of microfaults due to heat stresses.

Figure 15:
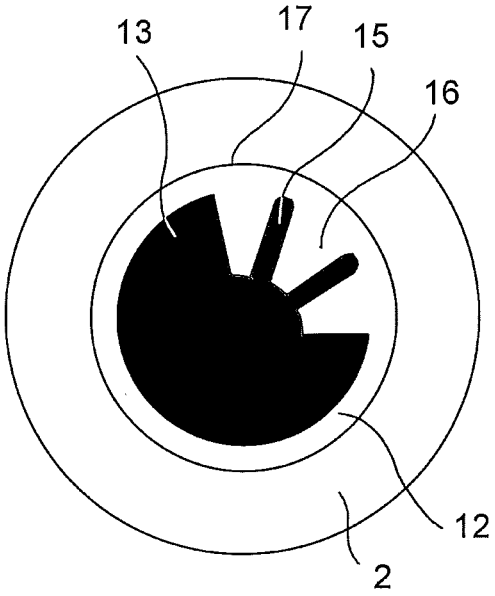
Figure 16:
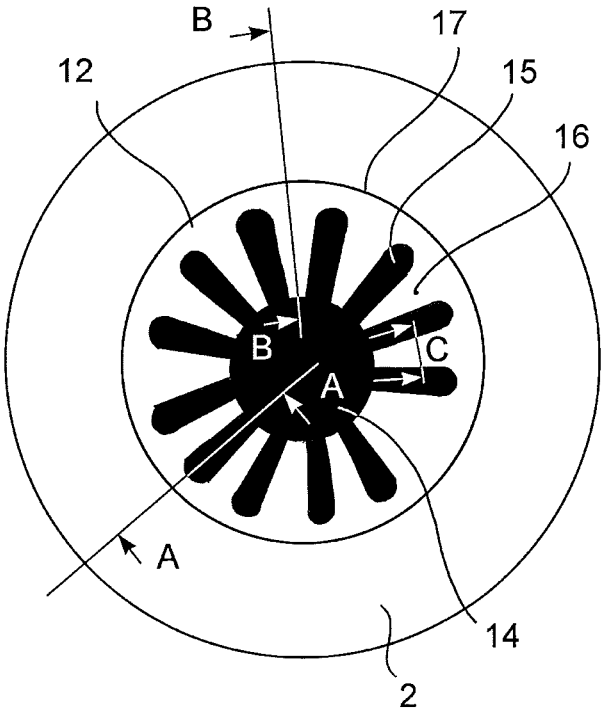
FIG. 16 is a top view of a distribution diaphragm according to the invention, with the indication of radial AA, BB and tangent CC sectional planes.
Figure 17:
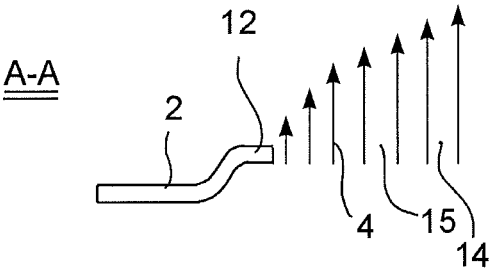
FIG. 17 shows the sectional view according to plane AA in FIG. 16, with a laminar flow at a peripheral passage section.
Figure 18:
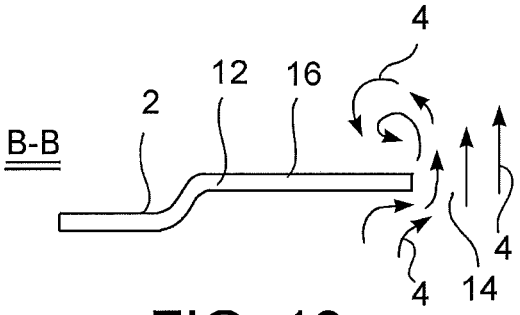
FIG. 18 shows the sectional view according to plane BB in FIG. 16, with a turbulent flow at a tab delimiting a central passage section, and a laminar flow more inside the central passage section.
Figure 19:
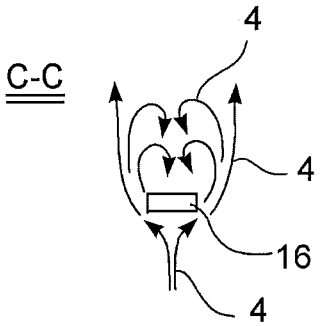
FIG. 19 shows the sectional view according to plane CC in FIG. 16, with a turbulent flow at a tab laterally delimiting peripheral passage sections, and a laminar flow more inside the peripheral passage sections.
Figure 20:
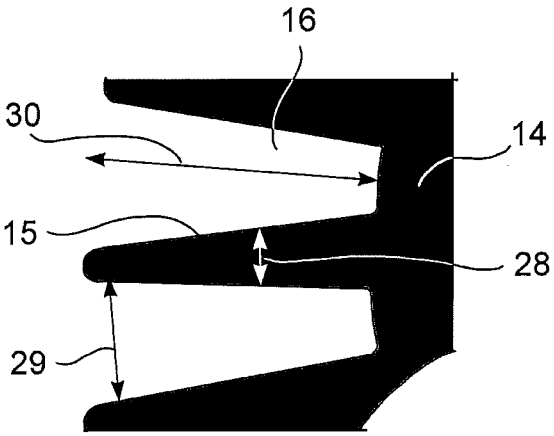
FIG. 20 is a top view of a detail of a distribution diaphragm, with the indication of certain geometric parameters.

In one embodiment, the central passage section 14, which is preferably circular or polygonal, has a smaller radial extension 18 than a radial extension 19 of the peripheral passage sections 15 (FIG. 15), resulting in a substantial portion of the inlet gas flow being distributed towards the peripheral regions of the burner without however being detached from the central flow.

Advantageously, the peripheral passage sections 15 become wider towards a (radially) outer end 20 thereof opposite to the central passage section 14, or form a (radially) outer end 20 widened with respect to an intermediate section 21 extending between the outer end 20 and the central passage section 14. Thereby, a more uniform quantitative distribution of the gas flow is obtained also in the peripheral regions of diaphragm 12.

In a preferred embodiment (FIGS. 3, 7), the peripheral passage sections 15 have a preferably identical "T" shape and are arranged in a circumferential succession with respect to the longitudinal axis 6 and preferably at a constant angular pitch. Each of the peripheral passage sections 15 forms a substantially rectilinear portion 21, oriented in a radial direction with respect to the longitudinal axis 6, and a rectilinear or curved tangent portion 22 substantially extending in the circumferential direction with respect to a longitudinal axis 6.

This embodiment of diaphragm 12 is particularly advantageous with reference to flame stability and to a uniform distribution of the combustion over the outer surface of the diffuser wall 5. Moreover, due to the continuity between the peripheral passage sections 15 and the central passage section 14 and the subsequent formation of sheet metal tabs 16 cantilevered with free ends, also the thermal stresses caused by diaphragm 12 itself are significantly reduced.

Advantageously, the width (in radial direction) of the tangent portion 22 is greater than the width (in circumferential direction) of the rectilinear portion 21.

In one embodiment, the peripheral passage sections 15 are positioned at a constant angular pitch.

In the embodiments shown in FIGS. 12, 13, 14 and 9, the peripheral passage sections 15 are distributed in a non-uniform manner around the central passage section 14, for example in one half alone (or even in one segment of circle alone smaller than 180°, for example 90°) of diaphragm 12, while the opposite half (or remaining segment of circle greater than 180°, for example 270°) is substantially or completely free from said peripheral flow sections 15. These non-symmetrical configurations may be advantageous in cases in which the space and heat exchange conditions in the combustion chamber around burner 1 have non-uniform features, and in which there is a desire to generate a greater quantity of heat on a given side of burner 1 and less heat on other sides.

According again to a further embodiment (FIG. 15), the tabs 16 are distributed in a non-uniform manner around the central passage section 14, for example in one half alone (or even in one segment of circle alone smaller than 180°, for example 90°) of diaphragm 12, while the opposite half (or remaining segment of circle greater than 180°, for example 270°) is substantially or completely free from said tabs 16 and therefore, is occupied by the distribution opening 13.

Figure 11:
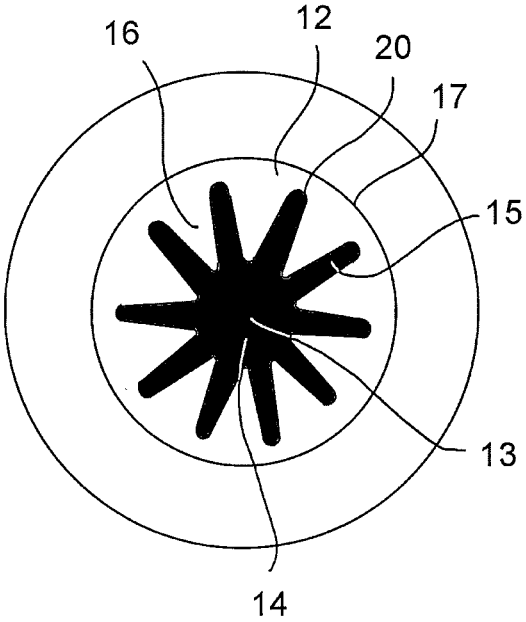

FIG. 11 shows an embodiment in which the peripheral passage sections 15 taper radially outwardly, giving the distribution opening 13 a star shape. This configuration allows opening 13 to be easily made by means of punching/cutting.

The tabs 16 may have, in top view, a trapezoid shape (FIGS. 8, 9), a trapezoid shape with a discharge or throat, e.g. rounded, at one angle (FIG. 10, "cleaver" shape) or both the angles (FIG. 13, "lance tip with broken tip" shape) of the larger base of the trapezoid. Here, the throat or the discharge is formed by the widened radially outer end 20 of the peripheral passage section 15.

Figure 12:
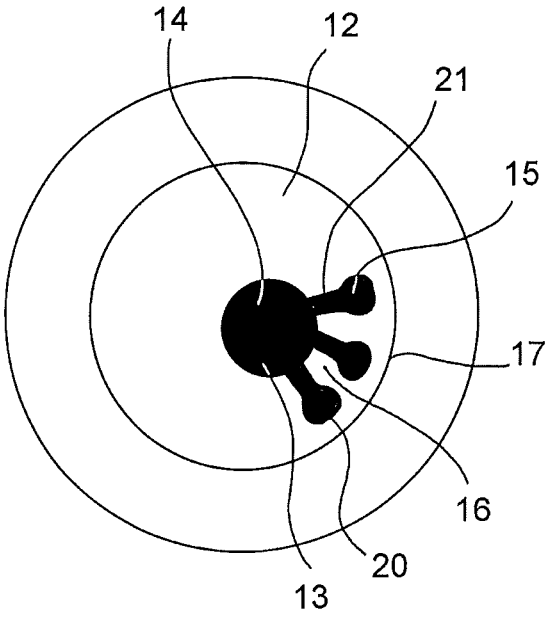
Figure 13:
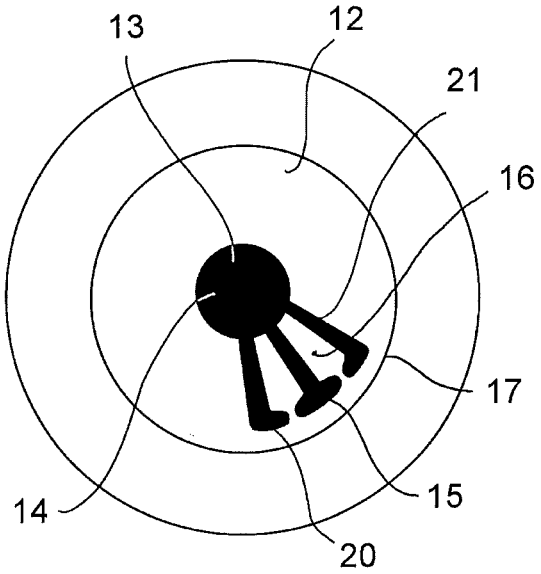

Alternatively, the tabs 16 may have, in top view, a triangle shape, for example isosceles (FIG. 11), or a triangle shape (e.g. isosceles) with a discharge or throat, e.g. rounded, at one or both the angles of the larger base of the triangle (FIG. 12, "pointed lance tip" shape). Also in this case, the throat or the discharge is formed by the widened radially outer end 20 of the peripheral passage section 15.

Figure 14:
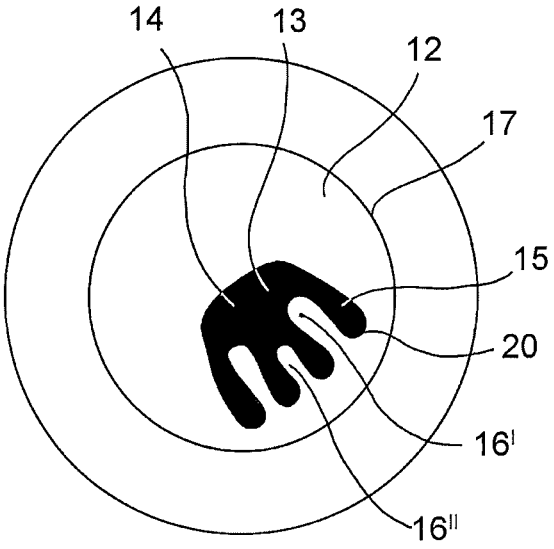

Finally, the tabs 16 may have radial lengths different from one another. For example, single (or groups of) longer tabs 16' may be alternated with single (or groups of) shorter tabs 16" (FIG. 14). Similarly, the peripheral passage sections 15 delimited by the tabs 16', 16" may also have variable radial lengths, for example alternating single (or groups of) shorter or longer peripheral passage sections 15.

Preferably, diaphragm 12 forms a single distribution opening 13 and substantially no other passage opening for gas 4.

In a preferred embodiment, the circumferential distance 28 between two adjacent tabs 16 is in the range from 0.8 mm to 8 mm. The maximum circumferential width 29 of the tabs 16 preferably may be in the range from 5 mm to 20 mm. The radial length 30 of the tabs 16 preferably may be in the range from 10 mm to 26 mm.

Diaphragm 12 may be shaped in a single piece with the support wall 2 or connected thereto, for example by means of welding or press-fitting.

Figure 6:
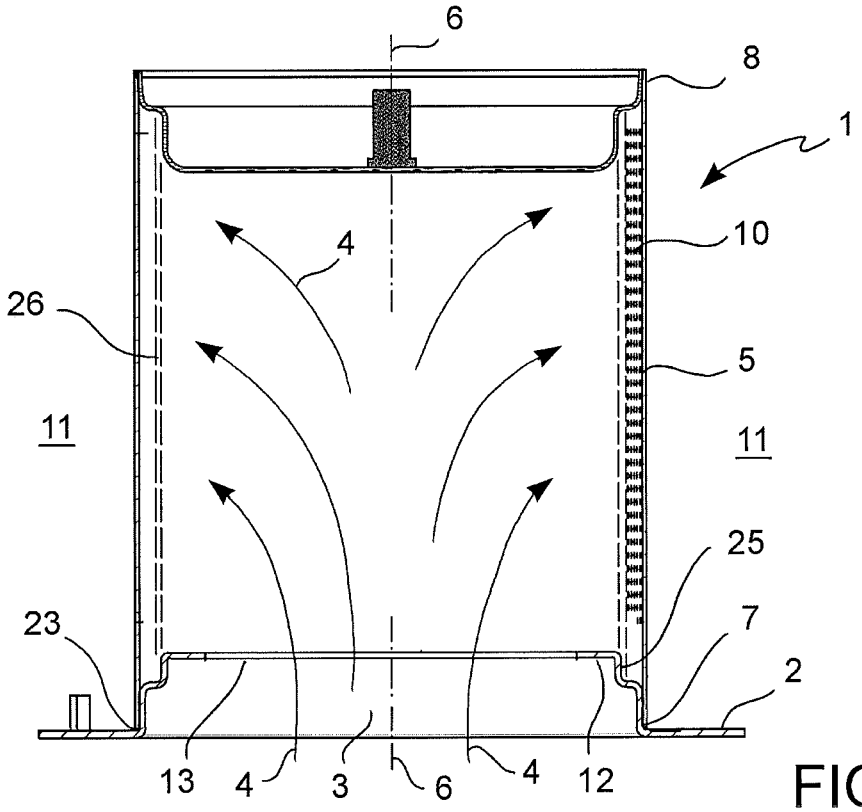
FIG. 6 is a longitudinal sectional view of the burner in FIG. 5.
Figure 7:
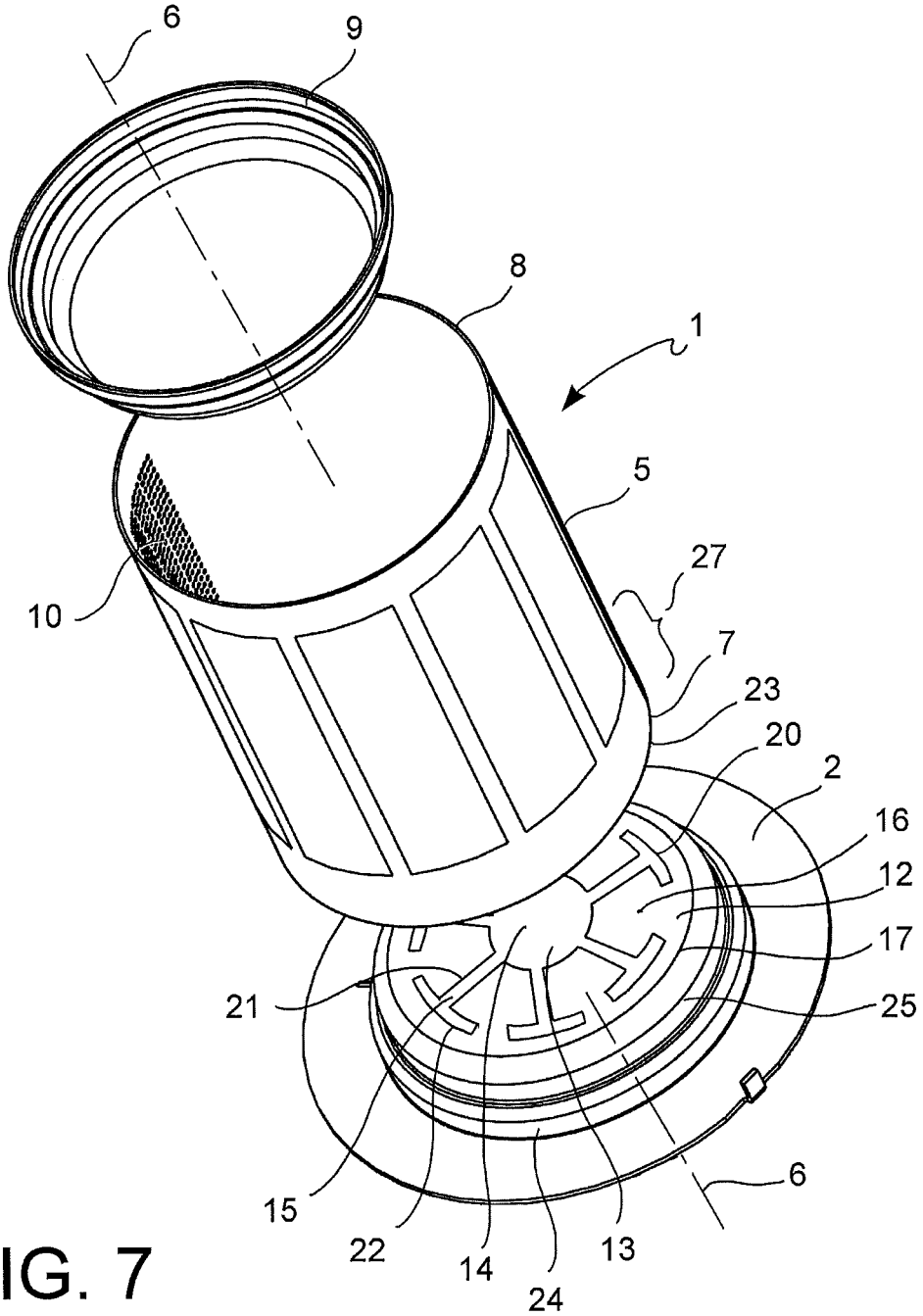
FIG. 7 is an exploded view of the burner in FIG. 5.
Figure 8:
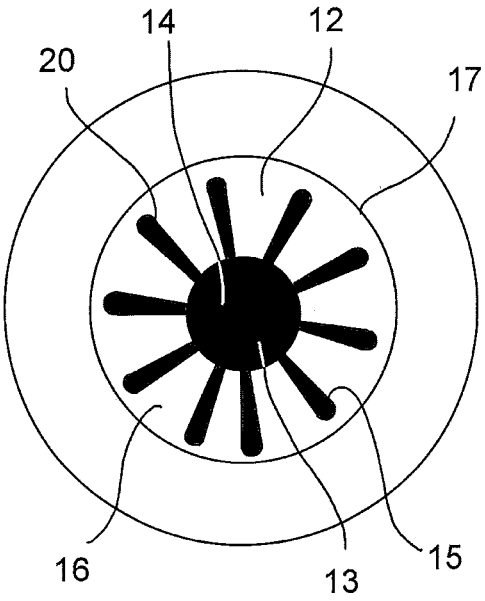
FIGS. 8 to 15 are top views of distribution diaphragms according to further embodiments.
Figure 9:
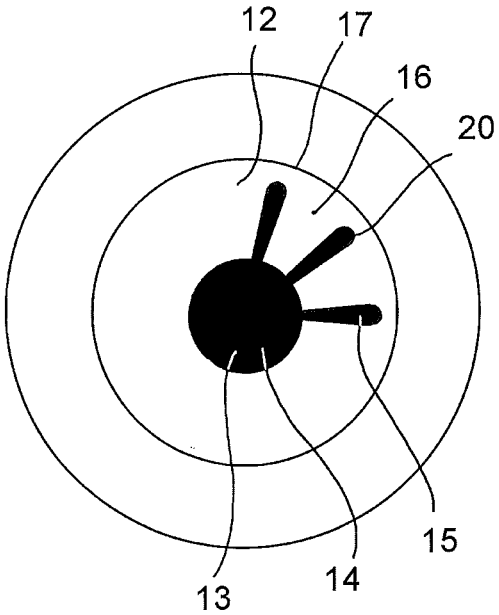
Figure 10:
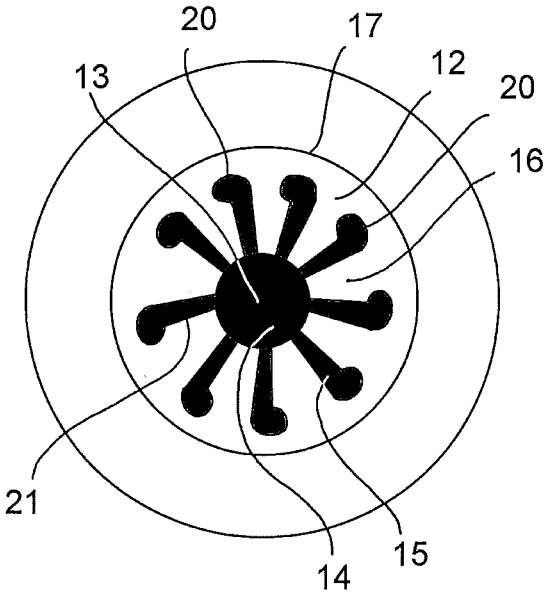

In an advantageous embodiment, the support wall 2 is made of metal sheet, e.g. of steel, and forms:

- an outer circumferential seat 24 (circumferential step) facing outwardly of burner 1 and suitable for receiving a front edge 23 of the diffuser wall 5,
- diaphragm 12,
- optionally, a further outer circumferential seat 24 (circumferential step) facing outwardly of burner 1 and adapted to receive a front edge of a further optional distribution wall 26, indicated with dotted lines in FIG. 6.

Advantageously, diaphragm 12 is positioned inside and does not extend beyond an end section 27 of the diffuser wall 5 at the support wall 2, in which said end stretch 27 has an axial length which is less than one fourth of the axial length of the diffuser wall 5, preferably less than one fifth of the axial length of the diffuser wall 5.

In a further embodiment, diaphragm 12 may form deflection edges which at least partially delimit said second passage sections 15 and which are bent outside the plane of diaphragm 12 so as to impart, to the mixture flow 4, a vorticity (swirl) in the direction circumferential to the longitudinal axis 6. This further prevents the formation of individual flows detached from one another.

According to one embodiment, the diffuser wall 5 comprises a perforated steel sheet and is cylindrical in shape or is in the shape of a slightly truncated cone. Additionally or alternatively, the perforated steel sheet of the diffuser wall 5 may be covered on the outside with an outer layer of mesh or fabric (not shown) made of metal or ceramic or sintered material, which forms the outer surface of the diffuser wall 5 on which the combustion takes place.

When provided, the aforesaid further distribution wall 26 may consist of a perforated steel sheet which is cylindrical in shape or is in the shape of a slightly truncated cone, which is coaxial with the longitudinal axis 6 and is positioned inside the diffuser wall 5.

The burner 1 according to the invention has several advantages, in particular a reduction of vorticity in the lower part of the burner, increased flame uniformity and stability, reduced noisiness, and less risk of local overheating of the diffuser wall, in addition to a free expansion of the various areas of the distribution diaphragm. Due to the flame uniformity and the homogeneous distribution of the combustion over the diffuser wall, the need to provide an additional distribution wall upstream of the diffuser wall 5 may be obviated in many application situations.

The invention claimed is:

1. A burner, comprising:

a support wall forming an inlet passage for introducing a fuel gas mixture into the burner, a diffuser wall connected to the support wall in flow communication with the inlet passage and having a perforation for the passage of the gas mixture from inside the burner to an outer side of the diffuser wall where combustion takes place, a distribution diaphragm arranged in the inlet passage and having a through distribution opening, wherein the distribution diaphragm is oriented substantially orthogonally to a longitudinal axis of the diffuser wall, wherein the distribution opening forms a central passage section distant from the diffuser wall and a plurality of peripheral passage sections, shaped as rays or branches, extended from the central passage section towards the diffuser wall, wherein the central passage section is circular or polygonal and concentric with the longitudinal axis of the diffuser wall, and wherein the peripheral passage sections and the central passage section are connected to each other to form a single hole.

2. The burner according to claim 1, wherein the diaphragm and the distribution opening have a substantially symmetrical shape with respect to the longitudinal axis.

3. The burner according to claim 1, wherein the peripheral passage sections extend radially outwardly so as to delimit a corresponding series of sheet metal tabs therebetween, such tabs projecting from a peripheral edge of the diaphragm cantilevered radially inwardly.

4. The burner according to claim 1, wherein the central passage section has a radial extension smaller than a radial extension of the peripheral passage sections.

5. The burner according to claim 1, wherein the peripheral passage sections become wider towards a radially outer end thereof opposite the central passage section, or form a radially outer end widened with respect to an intermediate section extended between the outer end and the central passage section.

6. The burner according to claim 5, wherein the peripheral passage sections have a "T" shape and are arranged in a circumferential succession around the central passage section, wherein each of the peripheral passage sections forms a substantially rectilinear portion, oriented in a radial direction, and a rectilinear or curved tangent portion substantially extended in the circumferential direction with respect to a longitudinal axis of the diffusion wall.

7. The burner according to claim 1, wherein the peripheral passage sections are positioned at a constant angular pitch.

8. The burner according to claim 1, wherein the peripheral passage sections are distributed in a non-uniform manner around the central passage section.

9. The burner according to claim 3, wherein the tabs may have, in top view, a trapezoid shape or a trapezoid shape with a throat at at least one of the angles of the larger base of the trapezoid, said throat being formed by a widened radially outer end of the peripheral passage section.

10. The burner according to claim 3, wherein the tabs may have, in top view, a triangle shape with a throat at at least one of the angles of the larger base of the triangle, said throat being formed by a widened radially external end of the peripheral passage section.

11. The burner according to claim 1, wherein the peripheral passage sections are radially tapered outwardly, giving the distribution opening a star shape.

12. The burner according to claim 1, wherein the tabs may have radial lengths different from each other.

13. The burner according to claim 1, wherein the diaphragm forms a single distribution opening and no other passage opening for the gas mixture.

14. The burner according to claim 1, wherein the circumferential distance between two adjacent tabs is in the range from 0.8 mm to 8 mm, and the maximum circumferential width of the tabs is in the range from 5 mm to 20 mm, and the radial length of the tabs is in the range from 10 mm to 26 mm.

15. A burner, comprising:

a support wall forming an inlet passage for introducing a fuel gas mixture into the burner, a diffuser wall connected to the support wall in flow communication with the inlet passage and having a perforation for the passage of the gas mixture from inside the burner to an outer side of the diffuser wall where combustion takes place, a distribution diaphragm arranged in the inlet passage and having a through distribution opening, wherein the distribution opening forms a central passage section distant from the diffuser wall and a plurality of peripheral passage sections, shaped as rays or branches, extended from the central passage section towards the diffuser wall, wherein the peripheral passage sections become wider towards a radially outer end thereof opposite the central passage section, or form a radially outer end widened with respect to an intermediate section extended between the outer end and the central passage section, wherein the peripheral passage sections have a "T" shape and are arranged in a circumferential succession around the central passage section, wherein each of the peripheral passage sections forms a substantially rectilinear portion, oriented in a radial direction, and a rectilinear or curved tangent portion substantially extended in the circumferential direction with respect to a longitudinal axis of the diffusion wall, and wherein the peripheral passage sections and the central passage section are connected to each other to form a single hole.

16. A burner, comprising:

a support wall forming an inlet passage for introducing a fuel gas mixture into the burner, a diffuser wall connected to the support wall in flow communication with the inlet passage and having a perforation for the passage of the gas mixture from inside the burner to an outer side of the diffuser wall where combustion takes place, a distribution diaphragm arranged in the inlet passage and having a through distribution opening, wherein the distribution opening forms a central passage section distant from the diffuser wall and a plurality of peripheral passage sections, shaped as rays or branches, extended from the central passage section towards the diffuser wall, wherein the peripheral passage sections extend radially outwardly so as to delimit a corresponding series of sheet metal tabs therebetween, such tabs projecting from a peripheral edge of the diaphragm cantilevered radially inwardly, wherein the tabs may have, in top view, a trapezoid shape or a trapezoid shape with a throat at at least one of the angles of the larger base of the trapezoid, said throat being formed by a widened radially outer end of the peripheral passage section, and wherein the peripheral passage sections and the central passage section are connected to each other to form a single hole.

17. A burner, comprising:

a support wall forming an inlet passage for introducing a fuel gas mixture into the burner, a diffuser wall connected to the support wall in flow communication with the inlet passage and having a perforation for the passage of the gas mixture from inside the burner to an outer side of the diffuser wall where combustion takes place, a distribution diaphragm arranged in the inlet passage and having a through distribution opening, wherein the distribution opening forms a central passage section distant from the diffuser wall and a plurality of peripheral passage sections, shaped as rays or branches, extended from the central passage section towards the diffuser wall, wherein the peripheral passage sections extend radially outwardly so as to delimit a corresponding series of sheet metal tabs therebetween, such tabs projecting from a peripheral edge of the diaphragm cantilevered radially inwardly, wherein the tabs may have, in top view, a triangular shape with a throat at at least one of the angles of the larger base of the triangle, said throat being formed by a widened radially external end of the peripheral passage section, and wherein the peripheral passage sections and the central passage section are connected to each other to form a single hole.

18. The burner according to claim 15, wherein the diaphragm is oriented substantially orthogonally to a longitudinal axis of the diffuser wall.

19. The burner according to claim 18, wherein the central passage section is circular or polygonal and concentric with the longitudinal axis.

* * * * *